United States Patent [19]

Sudrabin

[11] Patent Number: 4,619,032

[45] Date of Patent: Oct. 28, 1986

[54] METHOD OF FORMING A COMPOSITE WALL FOR A BUILDING STRUCTURE

[75] Inventor: David A. Sudrabin, Delray Beach, Fla.

[73] Assignee: Fibrestone Incorporated, LaBelle, Fla.

[21] Appl. No.: 758,321

[22] Filed: Jul. 24, 1985

Related U.S. Application Data

[63] Continuation of Ser. No. 594,810, Mar. 29, 1984, and Ser. No. 506,526, Jun. 22, 1983.

[51] Int. Cl.[4] ..... B23P 19/04

[52] U.S. Cl. ..... 29/460; 29/464; 29/505; 29/509; 52/297; 52/601; 52/612; 264/263

[58] Field of Search ..... 29/458, 505, 460, 509, 29/155 R, 433, 509, 464, 559; 52/545, 587, 361, 612, 297, 601, 359, 705, 405; 264/35, 263

[56] References Cited

U.S. PATENT DOCUMENTS

| | | | |
|---|---|---|---|
| 1,624,802 | 4/1927 | Rebell | 52/587 X |
| 2,151,399 | 3/1939 | White | 52/587 X |
| 2,940,295 | 6/1960 | Post | 52/601 X |
| 3,435,580 | 4/1969 | Merrill et al. | 52/405 |
| 3,464,211 | 9/1969 | Andresen | 52/587 X |
| 3,722,160 | 3/1973 | Bentley | 52/587 X |
| 3,868,296 | 2/1975 | McKeon, Jr. et al. | 52/612 X |
| 3,920,609 | 11/1975 | Lehmann | 264/263 X |
| 4,185,437 | 1/1980 | Robinson | 52/601 |
| 4,472,919 | 9/1984 | Nourse | 52/601 |
| 4,531,338 | 7/1985 | Donatt | 29/460 X |

FOREIGN PATENT DOCUMENTS

| | | | |
|---|---|---|---|
| 2400928 | 9/1974 | Fed. Rep. of Germany | 52/601 |
| 1171513 | 1/1959 | France | 52/601 |

*Primary Examiner*—Charlie T. Moon

*Attorney, Agent, or Firm*—Alfred E. Wilson

[57] ABSTRACT

In the Fibrestone Building Construction a thin fiber reinforced wall formed of sprayed concrete and short lengths of fibers, such as glass fibers, forms the outer shell of the wall exposed to atmosphere. An inner load supporting structure is secured to the inner surface of the outer shell. This load supporting structure consists for example of a metal frame aligned with the inner surface of the shell, and spaced metal studs. A differential of temperature exists between the outer surface of the fiber reinforced shell subjected to atmospheric temperatures and the inner load supporting structure because the inner members are shielded from atmospheric temperatures by the outer shell. The outer and inner members of the wall being formed of different materials have different coefficients of expansion when subjected to varying temperatures. Therefore, if the outer and inner members are directly connected by metallic connectors, welded or otherwise secured, the connectors will be subjected to severe loading which will eventually break the connectors loose from one of the members. These difficulties can be overcome by employing a plurality of flex tie connectors having one end bonded to the inner surface of the outer shell and the other end connected to the metallic studs or to the frame, preferably at two spaced points remotely spaced from the inner surface of the outer shell.

10 Claims, 11 Drawing Figures

Fig.-3
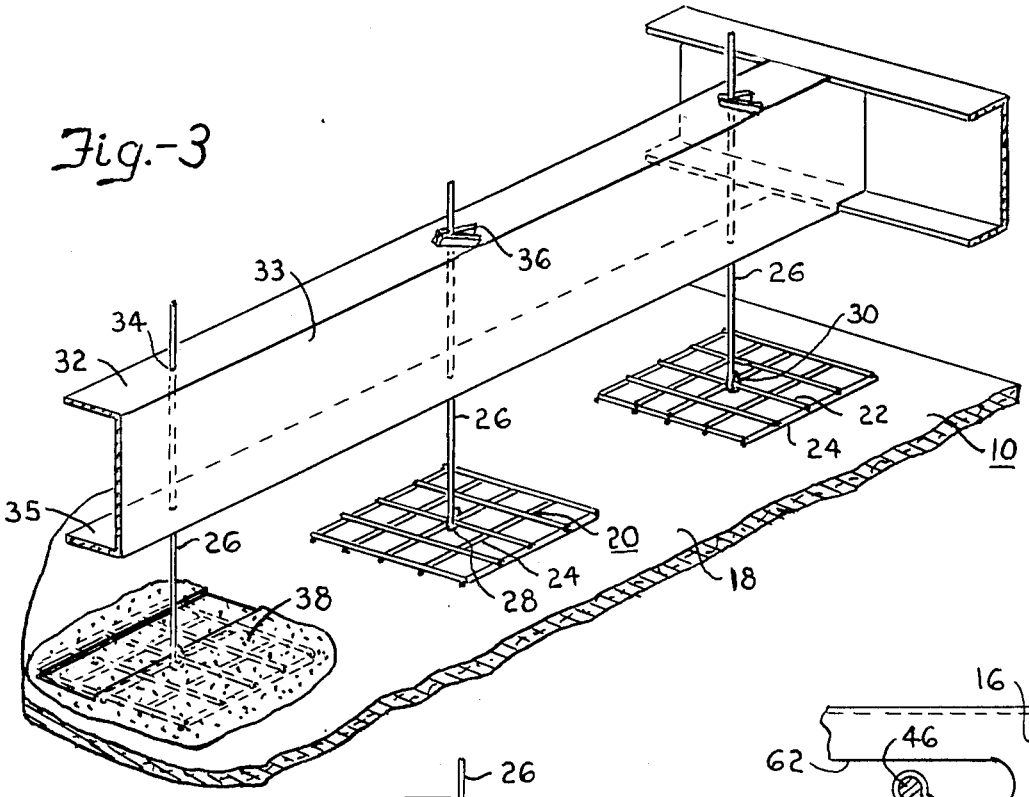
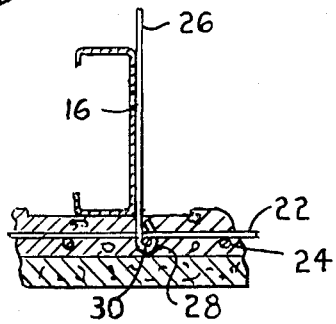
Fig.-2
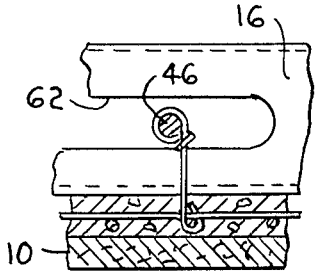
Fig.-4
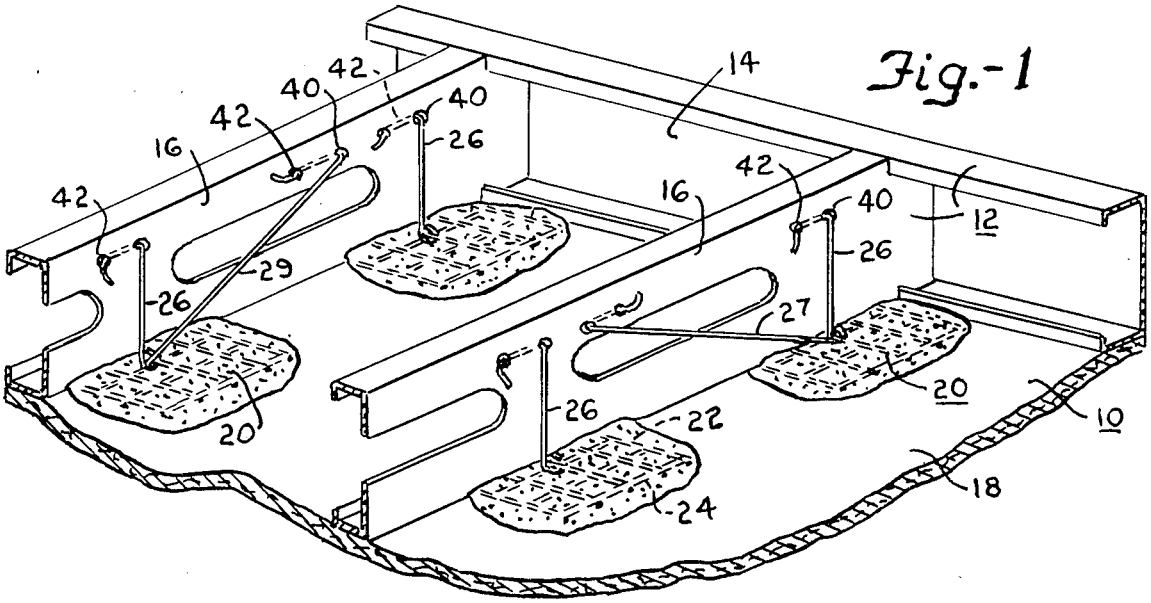
Fig.-1

Fig.-5
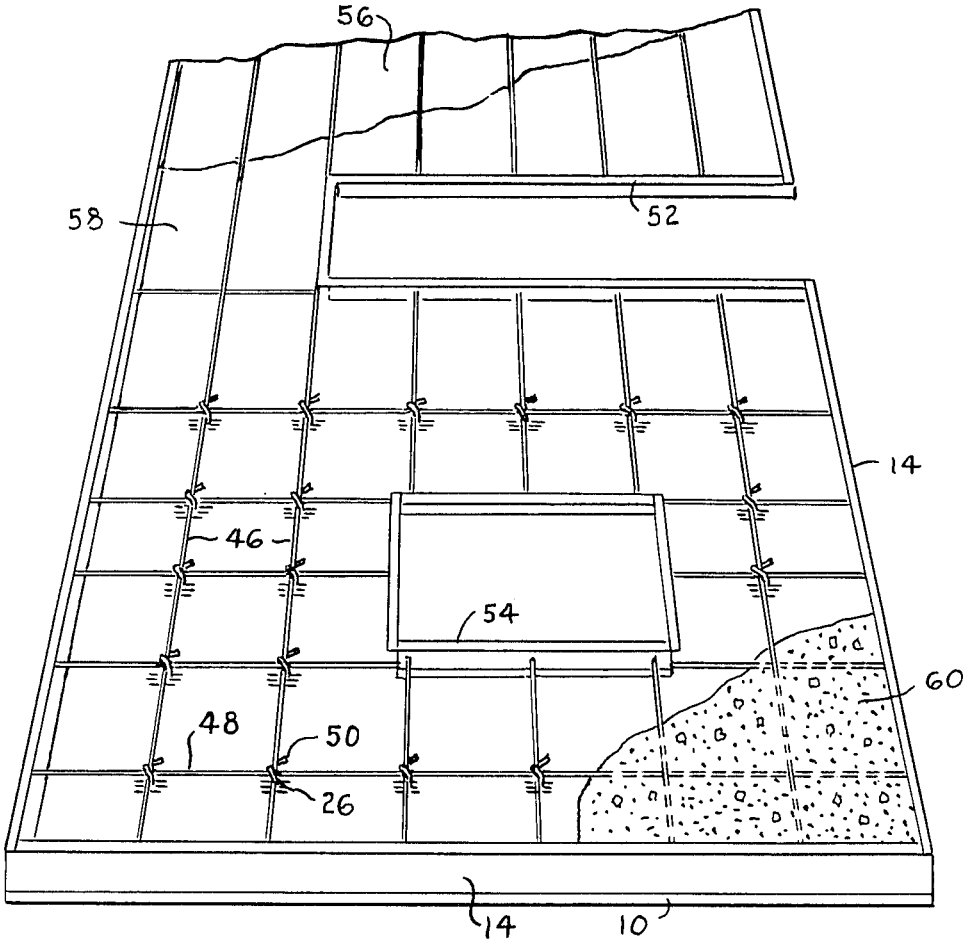
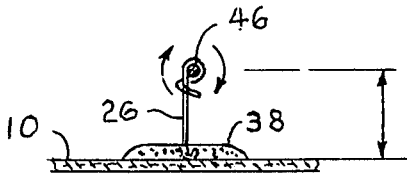
Fig.-6

METHOD OF FORMING A COMPOSITE WALL FOR A BUILDING STRUCTURE

CROSS REFERENCE TO RELATED APPLICATIONS

This Application is a Continuation of my earlier filed copending applications Ser. No. 506,526, filed June 22, 1983; and Ser. No. 594,810, filed Mar. 29, 1984.

BACKGROUND OF THE INVENTION

In the building construction where outer and inner wall members are employed, the outer wall is subjected to atmospheric temperatures, and the inner wall is shielded by the outer wall and is therefore subjected to different temperatures than is the outer wall. Heretofore it has been common practice to directly connect these outer and inner walls by short coupled metal links secured directly as by welding to the outer and inner members. The metal links are subjected to recurring stresses as the outer and inner walls are subjected to different temperatures, and eventually a breakage occurs, either in the link or at the connection of the link to one of the wall members. This has presented a dangerous situation.

FIELD OF THE INVENTION

This invention is directed to the connection of a fiber reinforced outer shell that is exposed to atmospheric conditions to an inner load supporting structure by flex tie members bonded at one end over relatively large areas to the inner surface of the outer shell, and connected to the load supporting structure at points spaced remotely from the inner surface of the outer shell.

DESCRIPTION OF THE PRIOR ART

The prior art connectors heretofore used in situations of this nature utilized direct metallic rods or bars secured in the outer wall structure and fastened as by welding directly to an adjacent portion of the inner framework structure in such a manner that no movement was possible between the members. There was thus no way to compensate for variations caused by different coefficients of expansion of the outer and inner members as they were subjected to variations of temperature. The prior art connectors subjected to recurring high stresses broke at the connection of the connectors to one of the wall members.

SUMMARY OF THE INVENTION

This invention embodies flex tie connectors formed of reasonably heavy wire, each connector having a hook at one end engaging intersecting grid members bonded to the inner surface of the outer fiber reinforced shell. The other ends of the flex tie members are connected to the metallic members of the load supporting structure in a plane spaced from the inner surface of the outer shell. The flex tie connectors may be securely connected to the load supporting structure by being pulled through spaced holes in the metal studs or frame of the load supporting members in planes spaced away from the inner surface of the outer member.

The flex tie connectors are thus free to shift slightly in response to variations of temperature to compensate for the variations of the coefficients of expansion of the outer and inner members.

These flex tie connectors can also locate reinforcing rods relative to the inner surface of the outer shell in instances where concrete is used to increase the load supporting capacity of the wall, and to increase the thermal mass of the wall to provide a wall having more stable heat transfer characteristics which delays the transfer of heat or cold through the wall by the energy storing capabilities of the concrete.

BRIEF DESCRIPTION OF THE DRAWINGS

FIG. 1 is a fragmentary perspective view of a portion of a Fibrestone Wall showing the attachment of the outer fiber reinforced shell to the load supporting structure.

FIG. 2 is a fragmentary view showing a step in the attachment of the outer shell to the load supporting structure.

FIG. 3 is a fragmentary perspective view illustrating some of the steps in connecting the load supporting structure to the outer shell.

FIG. 4 is a fragmentary sectional view illustrating the attachment of a flex tie connector to a reinforcing bar.

FIG. 5 is a perspective horizontal view illustrating the use of flex tie members connected to the outer shell to locate reinforcing bars in a wall wherein concrete is to be placed.

FIG. 6 is a fragmentary sectional view illustrating the use of the flex tie members to secure the fiber reinforced shell to the reinforcing bars.

DESCRIPTION OF THE PREFERRED EMBODIMENT

Figure 7:
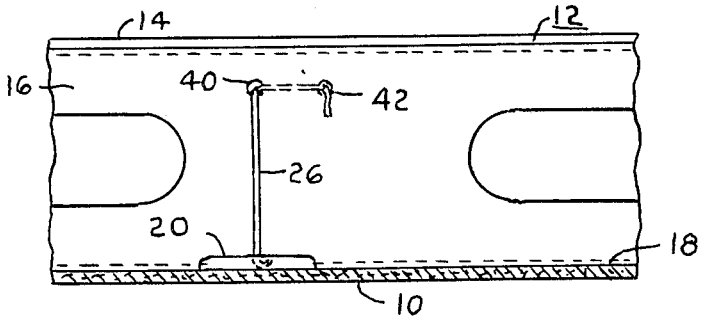
FIG. 7 is a fragmentary sectional view illustrating the attachment of the fiber reinforced outer wall to the load supporting structure of the Fibrestone Type 1 Wall.

The Fibrestone Wall has a thin outer fiber reinforced wall or shell 10 formed for example by simultaneously spraying concrete and reinforcing fibers, such for example as glass fibers, into a mold having a surface therein which it is desired to reproduce. The build-up of sprayed material on the mold surface may be manipulated to make it of substantially uniform thickness over the entire area of the mold, and preferably ranging from approximately $\frac{1}{4}''$ to $\frac{1}{2}''$ in thickness.

In the formation of the Fibrestone Wall the thin outer preformed fiber reinforced shell 10 is positioned horizontally on a substantially flat surface, such as the concrete foundation of a building, with the mold contacted surface of the fiber reinforced shell in a face down position, and with its inner surface 18 facing upwardly.

A load supporting structure 12 is positioned in alignment with the inner surface 18 of the preformed fiber reinforced shell 10. This inner load supporting structure 12 may consist of a metal frame 14 aligned with the inner surface 18 of the outer shell or wall, and spaced metal studs 16 may be secured in the frame 14. In instances where increased load supporting characteristics or thermal mass for improved energy efficiency are required, concrete can be placed in the frame 14 to provide a solid wall within the frame.

Heretofore in instances where two wall structures, an outer wall and an inner wall, have been secured together in a parallel relation, it has been common practice to interconnect them with short metal rods or bars welded or otherwise secured to the spaced walls. With this construction difficulties have been encountered where the spaced wall members are subjected to variations of temperature, and particularly in instances where the spaced walls are formed of materials having different coefficients of expansion when subjected to variations of temperature. The outer wall or shell 10 is of course subjected to atmospheric temperatures, and the inner load supporting structure 12 is shielded by the outer wall and therefore is not subjected to such wide variations of temperature as are the outer wall members 10. Therefore, the expansion of the outer and inner walls are not the same, and the connections between the walls are therefore subjected to high stresses. Where temperatures vary through rather wide ranges of temperature over a substantial period of time the connections between the walls fracture or break.

The load supporting structure 12 consists for example of a framework 14 aligned with the inner surface 18 of the shell 10, and if desired having metal studs 16 secured in the frame 14 to increase the load supporting capabilities of the load supporting structure 12.

I have found that where the outer shell 10 is directly connected to the load supporting structure 12 by direct couples, the connectors are subjected to high stresses due to the fact that the inner load bearing structure 12 is shielded from the atmospheric conditions by the outer wall 10, and the outer wall is subjected to the full variations of the atmospheric temperatures. These loads frequently break the ties of the connectors to one of the wall members, resulting in serious damage to the wall.

To provide a connector having a sufficient degree of flexibility that it will not be subjected to breaking stresses due to the different coefficients of expansion of the materials of which the wall structures 10 and 12 are made, I employ relatively long flex tie connectors secured to the inner surface 18 of the outer shell 10 at one end, and to the studs 16 or to the frame 14 at points remotely spaced from the inner surface 18 of the shell 10 at the other end of the connectors. These relatively long flex tie connectors permit slight shifting of the wall members 10 and 12 relative to each other and thus maintain the wall members 10 and 12 in assembled relation without subjecting the flex ties to breaking stresses.

To provide a secure anchorage to the inner surface 18 of the outer shell 10 I secure a plurality of spaced patches 20 consisting of thin intersecting wire or plastic strands 22 and 24 securely locked together as by welding or fusing to provide a strong matrix. The patches 20 dependent on the loading to which they are to be subjected, may have various sizes of intersecting wires or strands 22 and 24 positioned for example 1"×1" or 2"×2" apart, or other suitable spacing, and the patches or strands 20 may be of any desired size such for example as 2" square to 4" square or even larger, such as are necessary to carry the load without fracture of the cementitious or fibrous materials.

Flex tie members 26 are bent to provide hooks 28 are adapted to hook over a pair of the intersecting wires or strands 22 and 24, preferably at the approximate middle of the patches 20, but it will be understood that the hook can engage any of the intersecting strands 22 and 24. After the hooks 28 engage a pair of intersecting wires or strands 22 and 24, the end 30 of the hook 28 may be pulled or squeezed to tighten the hook 28 around the selected intersecting wires. The flex tie connectors 26 stand upright from the patches 20, and are of a length to extend alongside of the studs 16 so as to be secured for example to the studs at points remote from the inner surface 18 of the shell 10 as illustrated in FIG. 1.

Where the studs 16 are employed in the load supporting structure 12, the studs may be set on 12" to 16" or larger centers mounted in the frame 14 at the proper setting to comply with the building regulations at the point of use to establish the necessary spacing between the studs to comply with the regulations.

A plurality of flex tie connectors 26 are employed to secure each of the studs 16 to the inner surface 18 of the shell 10. The desired spacing of the flex tie connectors 26 longitudinally of the studs 16 is determined, ranging from approximately one flex tie per linear foot of the length of the studs to approximately three feet or more between the connectors, dependent on the anticipated loading.

FIG. 3 discloses steps in establishing the connection between the shell 10 and the load supporting structure 12. A fixture 33 similar to studs 16 has a lower flange 35 of a width corresponding to the width of the patches 20, and has apertures 34 to receive the flex ties.

The fixture 33 having a wider flange member 35 and having the flex tie connectors 26, each with a patch 20 in place on the hooked end 28–30 of the connectors 26 are slipped through the apertures 34 in the lower end upper flanges 35 and 32. When the connectors 26 project through the apertures 34 in the upper flange 32 of a fastener 36 like an old fashioned clothes pin is clamped on the connectors 26 above the upper flange 32 to hold the connectors from falling out of the fixture 33.

When all of the connectors 26 are in place, the fixture 33 is lowered into position on the inner surface 18 of the outer shell 10 to check the accuracy of location. It will be noted that the fixture 33 is shifted slightly to the right when viewed in FIG. 3 to align the apertures 34 in the fixture 33 with the connectors 26 so that when the connectors 26 are aligned with the right hand side of the studs 16 the studs will be in the proper locations relative to the outer shell 10 as shown in FIG. 1.

When the accuracy of location has been checked the fixture 33 is elevated on suitable guides to the approximate position illustrated in FIG. 3 to provide a space beneath the fixture 33 into which a thin mixture of concrete, reinforced by the fibrous material such as glass fibers, may be sprayed to provide mounds 38 of sprayed up cement to bond the patches 20 to the inner face 18 of the shell 10. This operation to bond the patches 20 to the inner face 18 can be performed if desired before the sprayed up outer wall 10 has fully solidified.

When the sprayed up mounds 38 covering the patches 20 have been sprayed, the fixture 33 is moved downwardly to the suitable guides and the flex tie connectors 26 slide through the apertures 34 in the fixture 33 to flatten out the mounds 38 so that they are all of substantially equal height. If needed a vibrator can be employed to flatten out the mounds 38 to make them all of substantially equal thickness.

It will be understood that the lower flange 35 of the fixture 33 should be of sufficient width to flatten the mounds 38 of sprayed on material over substantially the entire area or width of the mounds 38 on both sides of the flex tie connectors 26 as shown in FIG. 2. This makes substantially all of the mounds 38 covering the patches 20 of substantially the same vertical height above the inner surface 18 of the shell 10. In instances where wide patches 20 are employed it may be necessary to extend the flange 35 of the fixture 33 by increasing the width of the flange 35 or by adding an extension in alignment with the flange 35.

If the patches 20 are relatively narrow, or if the studs 16 have relatively wide flanges, it may be unnecessary to use the fixture 33 because the holes 34 to accommodate the connectors 26 can be in the flanges of the studs and the studs can be used to align the flex tie connectors 26.

If desired angularly related flex tie connectors 27 and 29 as shown in FIG. 1 can be connected to spaced studs 16 to limit longitudinal movement of the shell 10 and the load supporting structure 12.

After the sprayed mounds 38 have been flattened out by the lower flange 35 of the fixture 33, the fixture may be elevated and left in place with the flex tie connectors 26 aligned vertically relative to the patches 20 to give time for the cement of the mounds 38 to solidify to hold the connectors 26 upright.

When the mounds 38 have attained a desired degree of set, the fixture 33 is removed, and it is replaced by the frame 14 with the studs 16 in place therein, and they are aligned with the webs of the studs 16 adjacent the upstanding flex tie connectors.

The upper ends of the flex ties are then deflected outwardly and they are bent and are projected through a first hole 42 in the studs 16 at a point remotely spaced from the patches 20. The flex ties are then deflected at a different angle and are forced back through a second hole 44 in the studs. This bending of the flex tie connectors 26 work hardens them so that the studs 16 and the frame 14 are securely held in assembled relation with the shell 10.

Attention is directed to the fact that the connections of the flex ties 26 to the outer shell 10 and to the studs 16 are spaced apart a considerable distance. This permits a slight degree of flexing and shifting caused by variations of temperature due to the fact that the shell 10 formed of concrete and the load supporting structure 12 formed of metal have different coefficients of expansion.

FIGS. 5 and 6 illustrate a wall construction wherein the outer wall or shell 10 is formed of concrete reinforced by fibers, such as glass fibers, to form the outer shell 10 of the building structure. A plurality of intersecting metallic reinforcing bars 46 and 48 are secured in the frame 14. The reinforcing bars are connected to the outer shell 10 by a plurality of flex tie connectors 26 secured to the inner surface 18 of the shell 10 by the patches 20 formed of instersecting wires or webbing 22 and 24. The flex tie connectors are wrapped about the intersection of the reinforcing bars 46 and 48 as illustrated at 50.

It will be noted that a doorway entrance frame 52 and a window frame 54 are positioned in the wall or shell 10. The horizontal reinforcing bars 46 are interrupted at the edges of the door and window frames. Also, the vertical reinforcing bars 48 are interrupted at the alignments of the door and window frames.

In the assembly of the FIG. 5 wall a suitable number of flex tie connectors 26 are secured to the inner surface 18 of the shell 10. The reinforcing bars 46 and 48 are positioned in place and their vertical location above the inner surface 18 of the shell 10 is maintained temporarily in any convenient manner as by the positioning of a block between the inner surface 18 and the reinforcing bars. The flex tie connectors 26 are then wrapped about the intersection of the reinforcing bars 46 and 48, as illustrated in FIG. 6, and the connectors 26 hold the bars 46 and 48 at the desired elevation.

When the bars 46 and 48 have been tied, concrete is placed in the frame 14 with the frame 14 and the shell 10 being positioned horizontally. When the concrete solidifies to a sufficient degree, the concrete can be sticken off by scraping a straight edge over the aligned frames since the frame 14 and the door and window frames 52 and 54 are all the same vertical height. This provides a wall having high thermal mass.

If insulation is desired in the FIG. 5 wall, panel or block type insulation 56 can be applied directly to the inner surface 18 of the shell 10 as illustrated at 56 and the flex tie connectors 26 can project through the insulation. After the reinforcing bars have been tied by the flex tie connectors and the insulation 56 installed if it is to be used, then concrete 60 is placed in the frame in contact with the insulation. This provices a highly efficient wall having high thermal mass, meaning a high concentration of concrete. A thermally efficient wall is thus provided because the insulation is positioned adjacent the inner surface 18 of the outer shell 10, and the wall embodies a high degree of thermal mass. Thermal mass as embodied in concrete has the capacity to store great quantities of heat or cold and to delay the transfer of heat or cold in or out.

A wide range of Fibrestone Walls are provided to meet the wall requirements of virtually all building structures.

The Fibrestone Type 1 Wall illustrated in FIG. 7 has the fiber reinforced outer wall or shell 10. The load supporting structure 12 has spaced studs 16 mounted in the frame which aligns with the inner surface 18 of the outer shell 10.

To minimize the effects of the recurring stresses which cause breakage and separation between outer and inner wall structures flex tie connectors 26 have their inner ends secured to patches 20 bonded to the inner surface 18 of the outer wall or shell 10. The outer ends of the flex tie connectors 26 are secured to the outer edges of the studs 16 in any desired manner as by being projected through a first series hole 40 in the outer edges of the web of the studs 16. Each of the flex tie connectors is then redirected, and is projected through a second series hole 42 spaced a short distance from the holes 40. The metal of the flex ties is work hardened as the flex ties are successively pulled through the holes 40 and 42 and they are tightened. By projecting the flex ties through the second hole 42 the wire of the flex ties is tightened and bonded to prevent substantial movement in either plane, however the flex ties are able to shift a few thousandths of an inch to reduce the strain on the connectors caused by variations of temperature on the outer shell 10 and the inner load supporting structure 12.

The Type 1 Fibrestone Wall is the most economical of the Fibrestone Walls, and is used where the walls are not subjected to excessive loads, and insulation is not required.

Any desired interior surface finishing may be applied to the upper edges of the load supporting frame 14 and the upper edges of the studs 16 to complete the wall and to render it unnecessary to apply separately applicable interior wall members. It will of course be understood that in use the wall is elevated to a vertical position.

Figure 8:
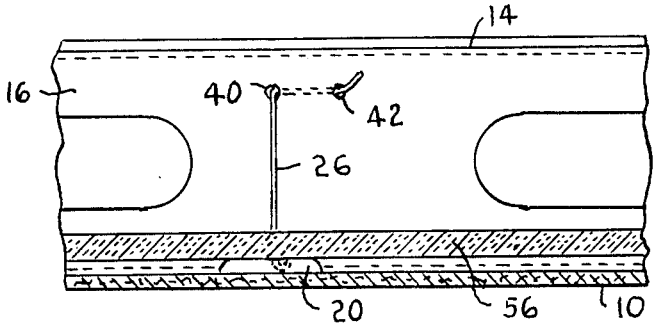
FIG. 8 is a fragmentary sectional view illustrating the attachment of the outer shell to the load supporting structure of the Fibrestone Type 3 Wall.

In instances where insulation is desired to protect against excessive variations of temperatures, the Fiberstone Type 3 Wall as illustrated in FIG. 8 may be employed. In this wall insulation 56 of the sheet or board type may be secured to the inner surface 18 of the outer wall or shell 10. It will be noted that the flex tie connectors 26 project though the insulation 56 to permit the connector to move slightly as required by variations of temperature. This Fibrestone Wall is very efficient and highly desirable because the insulation can be secured to the inner surface 18 of the thin outer shell 10. In this way the insulation is very close to the outer surface of the wall 10 that is exposed to the atmospheric conditions. Here again the inner surface of the wall can be formed by applying drywall or panelling or any other suitable covering for the load bearing structure including the exposed edges of the studs 16.

Figure 9:
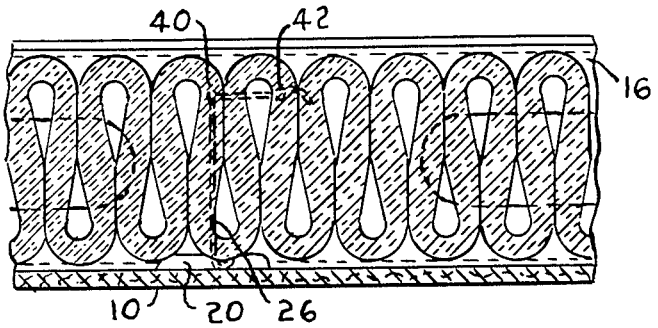
FIG. 9 is a fragmentary sectional view similar to FIGS. 7 and 8 illustrating the attachment of the outer shell to the load supporting structure wherein flex ties are used in the Fibrestone Type 5 Wall.

The Fibrestone Type 5 Wall as shown in FIG. 9 is another way of applying insulation to protect against excessive temperature changes to which the wall is subjected. With this wall, batt type insulation or relatively loose insulation may be employed to fill the chambers between the studs 16, and between the inner surface 18 of the shell 10 and the wall covering that is applied to the exposed surfaces of the load bearing structure.

The same excellent flex tie connector method of securing the outer fiber reinforced shell 10 to the outer extremity of the load supporting studs are employed to permit minute adjustments due to variations of temperature of the outer and inner members.

Fibrestone Walls, Types 2 and 4, illustrate walls which may be subjected to heavy loading, and which therefore have concrete placed in the space within the frame 14 aligned with the inner surface 18 of the shell 10. These walls have a high degree of thermal mass, meaning the ability resulting from the use of so much concrete to store heat or cold, thereby delaying the need to apply heating or cooling in order to maintain the temperature within a desired temperature range.

Figure 10:
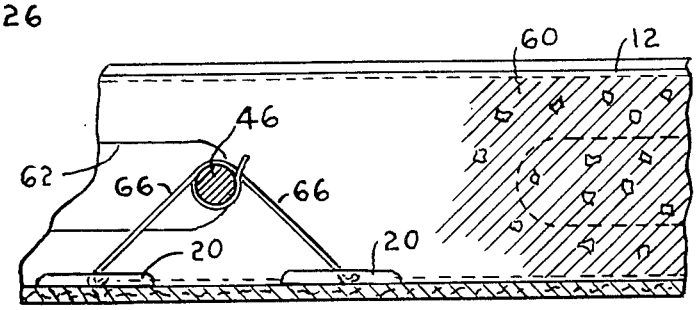
FIG. 10 is a fragmentary sectional view wherein flex tie members, interposed between the outer shell and reinforcing bars are employed in the Fibrestone Type 2 Wall wherein concrete is placed in the frame.
Figure 11:
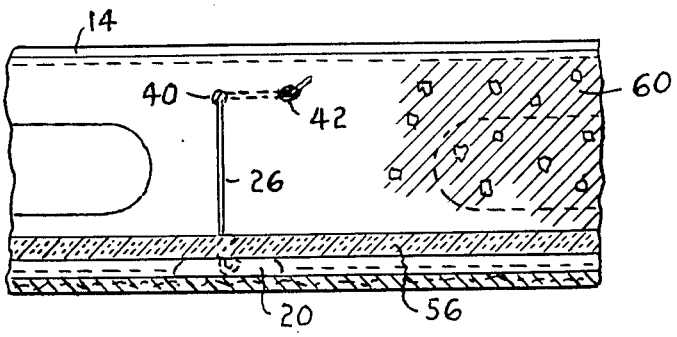
FIG. 11 is a view similar to FIGS. 7 to 10 illustrating the use of the flex ties in the Fibrestone Type 4 Wall wherein insulation and concrete are placed adjacent the outer shell.

Referring now in more detail to the Fibrestone Type 2 Wall as illustrated in FIG. 10, it will be noted that the studs 16 having cutouts 62 to reduce the weight of the studs and to permit concrete to flow through the studs may have metal reinforcing bars 46 extending through the aligned cutouts 62 of a plurality of spaced studs 16. In this instance the flex tie connectors 66 secured to patches 20 on the inner surface 18 of the shell 10 extend to and are wrapped around the reinforcing bars 46 to securely connect the outer shell 10 and the load supporting structure 12 at a point spaced from the inner surface of the shell 10.

In applying the flex tie connectors 66 to the Type 2 Wall of FIG. 10, the connection of the flex ties 66 with reference to the reinforcing bars are inclined at an appropriate angle to the patches 20 so that there is no need to exert a twist or deflection on the flex ties. The flex ties 66 are preferably applied while the outer wall or shell is horizontally disposed. To place the concrete 60 in the space 68 within the frame 14 and between the studs 16 the assembly is retained in the horizontal position. After the flex ties 66 are assembled as illustrated to connect them with the patches 20 bonded to the inner surface 18 of the shell 10, concrete is placed within the frame and flows through the cutouts 62. The frame is of uniform thickness and has a smooth upper surface. When the concrete placed in the frame assembly has attained a preliminary set the excess is "stuck off" in alignment with the upper surface of the frame whereupon a smooth surface is formed which may be used as the inner surface of the wall by painting or applying a wall covering thereto. Also, if desired, panelling or drywall can be applied as described in connection with some of the other Fibrestone Walls. This is a very strong wall having very high thermal mass.

The Type 4 Fibrestone Wall is a particularly thermally efficient wall having sheet insulation 56 contacting the inner surface 18 of the outer shell 10. The flex tie connectors 26 bonded at one end to the inner surface of the outer shell are connected to the studs through the spaced holes 40 and 42. The assembly is retained in the horizontal position when it is desired to place concrete in it. Of course, after concrete in the wall has solidified, the wall is elevated to the vertical position and is ready for use.

To provide the desired stress relieving connection between the shell 10 and the studs 16 it is desirable that the flex tie connectors 26 be elongated and that one end of the connectors be connected to the inner surface 18 of the shell 10 and that the outer end of the connectors 26 be connected to the studs 16 at a point well spaced from the inner surface 18 of the shell 10. The attachment of the flex tie connectors 26 to the studs 16 can be by any desired means such for example as by welding so long as the point of connection is well spaced from the shell 10, and that the connectors 26 be secured in such a manner as to prevent angular shifting of the connectors relative to the studs 16.

I claim:

1. The method of securing a metallic load bearing structure having a frame and spaced studs to the inner surface of a preformed fiber reinforced cement shell of a composite wall having an outer surface to be exposed to the atmosphere and having an inner surface, which comprises the steps of (1) positioning the shell in a substantially horizontal position with the inner surface facing upwardly, (2) selecting a plurality of spaced patches having intersecting tension members, (3) securing a flex tie connector to the intersecting tension members of each of the plurality of selected patches, (4) positioning a plurality of spaced patches on the exposed inner surface of the fiber reinforced shell, (5) spraying a slurry of cement and fiber reinforcements to secure the patches to the inner surface of the shell with the flex tie members in an upright position, (6) positioning the studs adjacent to and in alignment with the upstanding flex tie members, (7) deflecting and projecting the flex tie members through a first series of apertures in the studs at points remotely spaced from the inner surface of the fiber reinforced shell, and (8) deflecting and projecting the flex tie members through a second series of apertures in the studs whereby the flex tie members lock together the load bearing structure and the fiber reinforced shell.

2. The invention defined in claim 1 wherein a fixture having apertures therein is provided to receive the flex tie connector to hold them in an upright position relative to the inner surface of the fiber reinforced shell, moving the fixture in contact with the sprayed slurry of cement and fiber reinforcements to secure the patches to the inner surface of the shell and to substantially level the sprayed slurry over the patches, elevating the fixture to release the sprayed slurry and to hold the flex tie connectors in an upright position to permit the sprayed slurry to cure to hold the flex tie connectors in the upright position, and thereafter removing the fixtures and applying the studs adjacent to and in alignment with the upstanding flex tie connectors, and attaching the flex tie connectors to the studs at points remotely spaced from the attachment of the flex tie connectors to the inner surface of the shell.

3. The invention defined in claim 1 wherein sheet insulation is applied to overlie the sprayed slurry of cement and fiber reinforcements to secure the flex tie connectors to the inner surface of the shell, and the flex tie connectors project through the insulation and connect the inner surface of the shell to the studs at points remotely spaced from the inner surface of the shell.

4. The invention defined in claim 1 wherein batt type of relatively loose insulation is installed between the studs and between the inner surface of the shell and the outer surface of the wall.

5. The invention defined in claim 1 wherein reinforcing bars project through aligned cutout apertures in the studs and angularly disposed flex tie connectors secured at spaced points to the surface of the shell wrap about the reinforcing bars to clamp the load supporting structure to the inner surface of the shell, and concrete is placed in the wall.

6. The invention defined in claim 1 wherein sheet insulation overlies the inner surface of the shell and the patches connecting the flex tie connectors to the inner surface, and the flex tie connectors project through the insulation and are free to shift therein, and concrete is placed within the frame of the load bearing structure.

7. The method of forming a composite wall for a building structure having a relatively thin fiber reinforced cement shell having an outer surface exposed to the atmosphere and in inner surface, of uniform thickness, which comprises the steps of positioning the preformed fiber reinforced shell horizontally with its outer surface in a face down position, superimposing a frame on the shell, positioning in the frame a plurality of intersecting reinforcing bars, selecting a plurality of patches having intersecting tension members, securing a flex tie connector to engage intersecting tension members of each of the selected patches, positioning on the inner surface of the shell a plurality of spaced patches and flex tie connectors in alignment with certain of the intersecting reinforcing bars, spraying a slurry of cement to secure the patches to the inner surface of the shell, wrapping the flex tie connectors about the intersecting reinforcing bars, and placing concrete in the frame to fill the space within the frame above the inner surface of the shell, and striking off the concrete in alignment with the top of the frame when the concrete has attained a predetermined set.

8. The invention defined in claim 7 wherein sheet insulation is placed in the frame in contact with the inner surface of the shell and the sprayed slurry which secures the patches to the inner surface of the shell, and the flex tie connectors project through the insulation to permit slight shifting between the fiber reinforced shell and the load supporting structure after the concrete is placed in the frame.

9. The method of forming a composite wall for a building structure having, (a) a relatively thin outer shell formed of fiber reinforced cement and having an outer surface exposed to the atmosphere and an inner surface, and (b) a load supporting structure having a metal frame and spaced metal studs, which comprises the steps of, (1) positioning a preformed fiber reinforced shell horizontally with its outer surface in a face down position, (2) selecting a plurality of spaced patches having intersecting tension members, (3) securing a flex tie connector to intersecting tension members of each of the plurality of selected patches, (4) applying the selected patches to the inner surface of the outer shell with the flex tie connectors projecting upwardly from said patches, (5) applying a slurry of bondable substance to bond the patches to the inner surface of the shell with the flex tie connectors projecting upwardly therefrom in alignment with the location of the studs of the load supporting structure, (6) positioning the spaced metal studs of the load supporting structure of the inner surface of the fiber reinforced shell in alignment with the flex tie connectors, and (7) securing the flex tie connectors to the studs at points remotely spaced from the inner surface of the outer shell.

10. The invention defined in claim 9 wherein the flex tie connectors are welded to the studs at points remotely spaced from the inner surface of the outer shell.

* * * * *